US010165807B2

(12) United States Patent
Yeung et al.

(10) Patent No.: US 10,165,807 B2
(45) Date of Patent: Jan. 1, 2019

(54) LOW PROFILE BODY PROTECTION DEVICE

(76) Inventors: Adrienne Yeung, San Jose, CA (US); C. Douglass Thomas, Campbell, CA (US)

( * ) Notice: Subject to any disclaimer, the term of this patent is extended or adjusted under 35 U.S.C. 154(b) by 328 days.

(21) Appl. No.: 13/342,872

(22) Filed: Jan. 3, 2012

(65) Prior Publication Data

US 2012/0167284 A1 Jul. 5, 2012

Related U.S. Application Data

(60) Provisional application No. 61/429,051, filed on Dec. 31, 2010.

(51) Int. Cl.

| | |
|---|---|
| ***A42B 1/00*** | (2006.01) |
| ***A41D 13/05*** | (2006.01) |
| ***A42B 1/06*** | (2006.01) |
| ***A42B 1/08*** | (2006.01) |

(52) U.S. Cl.
CPC ..... *A41D 13/0593* (2013.01); *A42B 1/06* (2013.01); *A42B 1/08* (2013.01)

(58) Field of Classification Search
CPC ..... A42B 1/06; A42B 1/08; A41D 13/0593
USPC .... 2/411, 6.8, 438, 171.5, 204, 205, 209.12, 2/209.5, 195.5, DIG. 11
See application file for complete search history.

(56) References Cited

U.S. PATENT DOCUMENTS

| | | | | |
|---|---|---|---|---|
| 4,136,222 | A * | 1/1979 | Jonnes | 428/116 |
| 5,271,101 | A * | 12/1993 | Speth et al. | 2/228 |
| 5,365,607 | A * | 11/1994 | Benevento et al. | 2/181.4 |
| 5,661,854 | A * | 9/1997 | March, II | 2/410 |
| 5,918,309 | A | 7/1999 | Bachner, Jr. | |
| 5,951,503 | A * | 9/1999 | Pomatto | 602/17 |
| 7,650,648 | B2 * | 1/2010 | Roberts | 2/195.8 |
| 7,937,778 | B1 * | 5/2011 | Norton | 2/414 |
| 2003/0046747 | A1 * | 3/2003 | Berns | 2/69 |
| 2008/0040831 | A1 * | 2/2008 | Nilforushan et al. | 2/69 |
| 2008/0307569 | A1 * | 12/2008 | Roberts | 2/456 |

OTHER PUBLICATIONS

"Miguel Caballero Bulletproof Attire", www.miguelcaballerousa.com, downloaded Feb. 14, 2010, 1 pg.
"Brainwear for Smart People", YAKKAY, www.yakkay.com, downloaded Dec. 31, 2010, 2 pgs.
Rogers, "Non-Dorky Bicycle Helmets: Brainwear for Smart People", http://earthfirst.com/non-dorky-helmets-brainwear-for-smart-people, downloaded Dec. 31, 2010, 8 pgs.
Doctorow, "Bike Helmets that Look Like Hats", http://boingboing.net/2008/08/14/bick-helments-that-lo.html, downloaded Dec. 31, 2010, 36 pgs.
"Silicone Foam Tube", www.tootoo.com/d-rp23717631-silicone_foam_tube, downloaded Jan. 21, 2010, 4 pgs.
"Polyurethane FoamlRidge FoamlClosed Cell Foam", http://pleiger.com/foam.html, downloaded Jan. 21, 2010, 4 pgs.
(Continued)

*Primary Examiner* — Khaled Annis

(57) ABSTRACT

A protective clothing device having an article of clothing having an inner layer and an outer layer is disclosed. The protective clothing device may have at least one thin force absorbing member coupled to the inner layer or outer layer of the article of clothing. In one embodiment, the protective clothing device may be a protective hat.

18 Claims, 11 Drawing Sheets

(56) References Cited

OTHER PUBLICATIONS

"Bella Reversible Baby Beanie Hats", www.bella.com/baby-beanies.html, downloaded Jan. 18, 2010, 1 pg.
"Baby's 1st Head Gear—Accidental Head Injury in Baby", www.babysfirstheadgear.com/product.htm, downloaded Jan. 18, 2010, 2 pgs.
"Learning to Walk—Product Info", www.thudgard.com/producet-info, downloaded Jan. 18, 2010, 3 pgs.

* cited by examiner

LOW PROFILE BODY PROTECTION DEVICE

CROSS-REFERENCE TO RELATED APPLICATION

This application claims priority to U.S. Provisional Patent Application No. 61/429,051, filed Dec. 31, 2010, entitled "LOW PROFILE BODY PROTECTION DEVICE," which is herein incorporated by reference.

BACKGROUND OF THE INVENTION

Field of the Invention

The present disclosure relates generally to a body protection device, and more particularly, to a protective hat. Even more particularly, the present disclosure generally relates to a protective hat for every day use by a young child.

Description of the Related Art

Clothing generally serves to cover the user's body, protecting their skin from the weather. Additionally, clothing serves to keep the user warm. Clothing is generally made from cotton, polyester, denim, rayon, or some combination of those members. Clothing is generally ranges from light weight for hotter climates to heavy for colder climates. Heavier clothing serves to keep the user warmer in the colder climate. It is heavier due to more layers of cloth, down filling, or insulating thermal member.

Hats are a type of clothing that cover a user's head. They are usually fashionable or aesthetically pleasing to the individual. Hats come in many different varieties depending upon the functionality or intended use. Baseball caps, baby caps, beanies, sun visors, are a few of the different varieties. Generally, hats are meant to either conserver the user's heat by keeping them warm, protecting the user from the sun, or to complete a fashionable outfit.

Helmets are a type of head protection device that are less fashionable and more functional. Helmets usually are obtuse, have a hard coated outside with a large foam inside with additional padding to shape to the user head. Helmets generally are used by the user to protect the head from hard impacts sustained during the use of a motorized vehicle, bicycle, skydiving, or any other dangerous activity that jeopardizes the head. These helmets focus on protection for extreme activities, rather than style or everyday use.

SUMMARY OF THE INVENTION

A body protection device with a clothing component that looks like a regular item of clothing and a thin protective component is disclosed. In one embodiment, the clothing component may be a hat having at least one thin force absorbing member coupled to the interior surface or the exterior surface of the hat.

The invention can be implemented in numerous ways, including as a method, device or apparatus. Several embodiments of the invention are discussed below.

In one embodiment, the protective clothing device may be made from an article of clothing that has an inner layer and an outer layer. At least one thin force absorbing member can be coupled to the inner or outer layer of the article of clothing to form the protective clothing device.

In another embodiment, the protective clothing device is a protective hat. The protective hat may be made from a fabric covering with an interior and an exterior surface. At least one thin force absorbing member can be coupled in between the interior and the exterior surface of the fabric covering in order to form the protective hat.

In one embodiment, the method for making the protective hat could be implemented by obtaining a hat made from a fabric member. The hat may have an inner surface an exterior surface. The at least one thin force absorbing member may be shaped into a predetermined shape, and then can be coupled to the inner surface of the hat. The at least one thin force absorbing member may be concealed from view within the hat.

The invention provides other articles of clothing designed to form the protective clothing device, as well as other methods of coupling the thin protective member to the article of clothing. These and other features will be presented in more detail in the following detailed description of the invention and the associated figures.

BRIEF DESCRIPTION OF THE DRAWINGS

The accompanying drawings, which are incorporated into and constitute a part of this specification, illustrate one or more example embodiments and, together with the description of example embodiments, serve to explain principles and implementations.

In the drawings.

DETAILED DESCRIPTION OF THE INVENTION

Embodiments of the invention are discussed below with reference to FIGS. 1-9B. However, those skilled in the art will readily appreciate that the detailed description given herein with respect to these figures is for explanatory purposes as the invention extends beyond these limited embodiments.

The invention relates to a body protection device having a clothing component and one or more thin protective components provided with the clothing component. The thin protective components provide protection to a wearer of the clothing component. Advantageously, the thin protective components are substantially hidden so that the clothing component looks to others like a regular item of clothing. In one embodiment, the clothing component is a hat having at least one thin force absorbing member coupled to the interior surface or the exterior surface of the hat.

Figure 1:
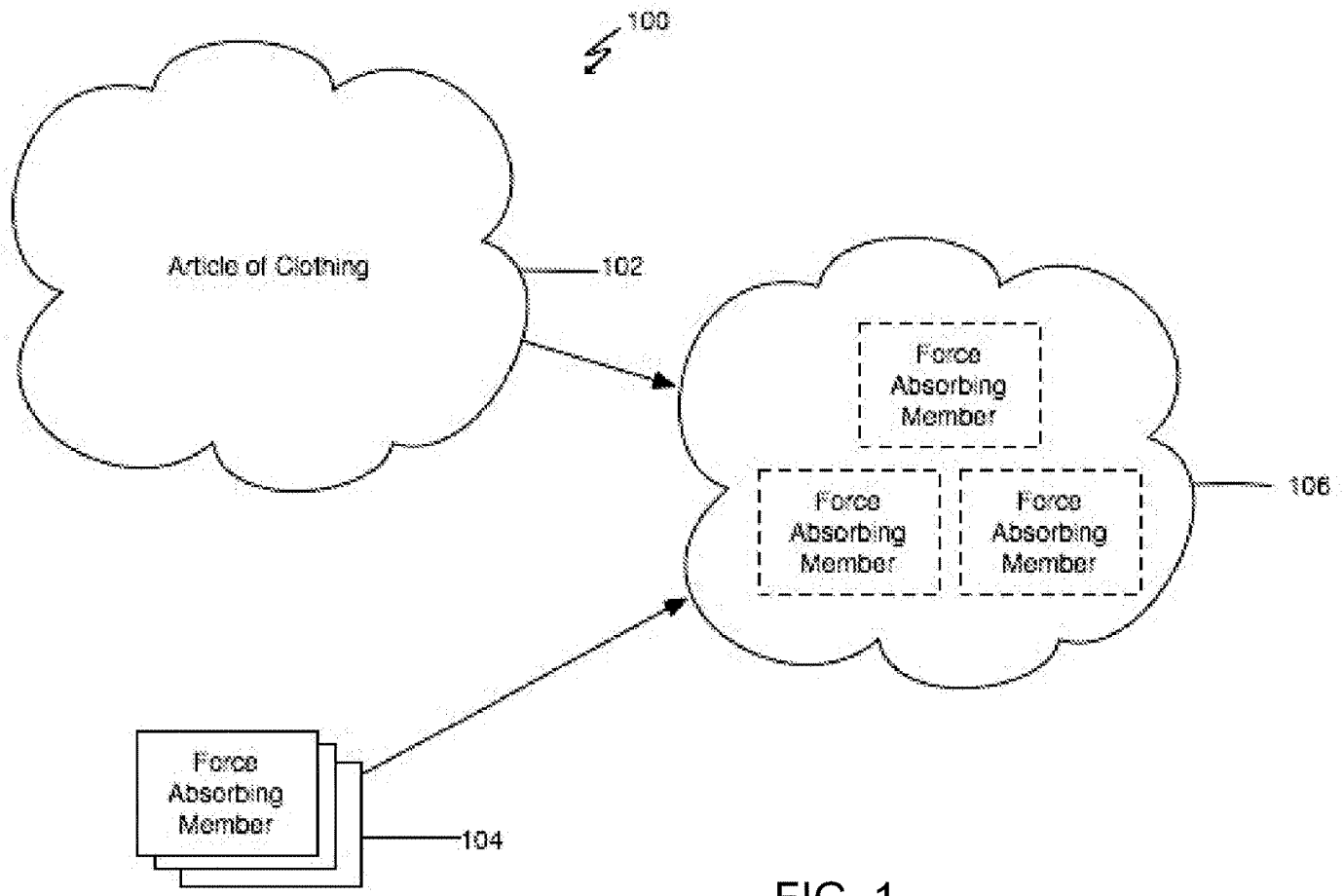
FIG. 1 illustrates a system for providing a body protection device according to one embodiment.

FIG. 1 illustrates a system 100 for providing a body protection device according to one embodiment. The body protection device can be an article of clothing and can thus be referred to as a protective clothing device. As shown in FIG. 1, the system 100 has an article of clothing 102 and one or more force absorbing members 104. The system 100 can then operate to secure the force absorbing members 104 to the article of clothing 102 to form a protective clothing device 106.

The article of clothing 102 may have an inner layer and an outer layer. The article of clothing 102 may be any known article of clothing such as a head gear (e.g., hat, headband), pair of pants, shirt, foot wear (e.g., sock) and the like. The article of clothing 102 may be made from a fabric material. The fabric material may be any woven material made from any material such as polyester, cotton, rayon, wool, plastic, and the like. The fabric material may be breathable, durable, stretchable, machine washable, or water resistant.

The thin force absorbing member 104 may be formed into a predetermined shape. The thin force absorbing material 204 may be formed in a uniform shape, such as a square, triangle, circle, rectangle, oval, star, trapezoid, and the like, or may be formed in an arbitrary or irregular shape. The at least one thin force absorbing material 204 may be selected from a group of high-density and elastic materials, such as elastomer, polyurethane foam, gel, silicone, and the like.

The thin force absorbing member 104 may be secured to the article of clothing 102 in any of a variety of different ways. Typically, for aesthetic reasons, the thin force absorbing material 102 may be coupled to the inner surface of the article of clothing so as to not be outwardly visible to others when the protective clothing device 106 is being worn. In one embodiment, the at least one thin force absorbing material 104 may be coupled between the inner surface and the outer surface of the article of clothing 102. In another embodiment, the protective clothing device 106 may include one or more enclosures that are configured to receive the thin force absorbing member 104. Each of the one or more enclosures may be designed to receive one or more of the at least one thin force absorbing members 104. The at least one thin force absorbing member 104 may be secured to or coupled to or between the inner surface and/or the outer surface of the article of clothing 102 via any known securing method such as by sewing, adhesives, snaps, hook and loop fasteners, screws, and the like.

In one embodiment, the body protection device 106 is a protective head gear, such as a hat, headband, etc. For example, in one implementation, the body protective device 106 is a protective hat that serves to provide force absorbing protection to a conventional hat.

Figure 2:
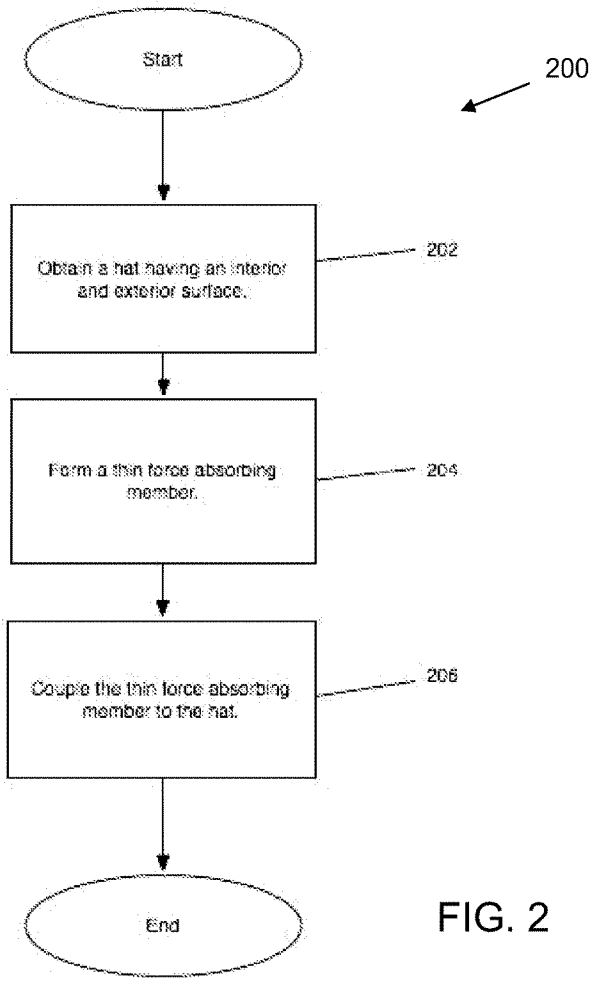
FIG. 2 illustrates one example method for making a protective hat according to one embodiment.

FIG. 2 illustrates one example method 200 for making a protective hat according to one embodiment. The protective hat having an interior surface and an exterior surface is obtained at 202. The hat may be made from a fabric material. The hat may be any known hat such as a beanie, a knitted hat, woven hat, a cap, and the like. The fabric material may be any woven material. The woven material may include one or more of polyester, cotton, rayon, wool, plastic, and the like. The fabric material may be breathable, durable, stretchable, machine washable, and/or water resistant.

A thin force absorbing member may be formed at 204. The thin force absorbing member may be at least one thin force absorbing member to be secured to the hat. The thin force absorbing member may be formed into a predetermined shape. In one embodiment, the thin force absorbing member may be formed in a uniform shape, such as a square, triangle, circle, rectangle, oval, star, trapezoid, etc. Examples of some uniform shapes are illustrated in FIG. 3. In another embodiment, the thin force absorbing member may have an arbitrary or custom shape, such as a mesh, shapes conforming to the configuration of the protective hat, combination of shapes (e.g. FIGS. 4 and 5). The thin force absorbing member can be molded (e.g., injection molded), stamped or cut from a sheet of force absorbing material, and the like.

The thin force absorbing member may be formed from any known material that has characteristics of elasticity, durability, high-density, flexibility, moldability and the like. The at least one thin force absorbing material may be selected from a group of high-density and elastic materials, such as elastomer, polyurethane foam, gel, silicone, and the like.

The thin force absorbing member may be coupled to the protective hat at 206. In some cases, there are multiple force absorbing members that are to be coupled to the protective hat. In other cases, there may be a single force absorbing member coupled to the protective hat.

In one embodiment, the thin force absorbing member can be coupled to an inner surface. In one embodiment, the thin force absorbing member may be coupled between the inner surface and the outer surface of the hat. The thin force absorbing material may be coupled between the inner surface and the outer surface of the hat via any known securing method such as by sewing, adhesives, snaps, hook and loop fasteners, screws, and the like.

In another embodiment, the hat may have an enclosure between the inner surface and the exterior surface designed to receive the at least one thin force absorbing material. The thin force absorbing member may be inserted into the enclosure and secured within the enclosure by any known means such as the use of zippers, snaps, hook and look fasteners, and the like.

In yet another embodiment, the inner surface of fabric material may form a pocket with the outer surface of fabric material, so that the inner surface and the outer layer are configured to receive and conceal the at least one thin force absorbing material.

In still another embodiment, the at least one thin force absorbing member may be coupled to the outer surface of the hat via any known securing method such as by sewing, adhesives, snaps, hook and loop fasteners, screws, and the like.

Figure 3B:
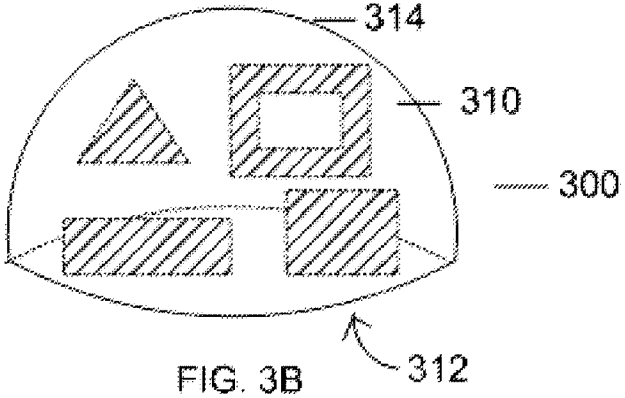
FIG. 3B illustrates a protective hat according to one embodiment.
Figure 3A:
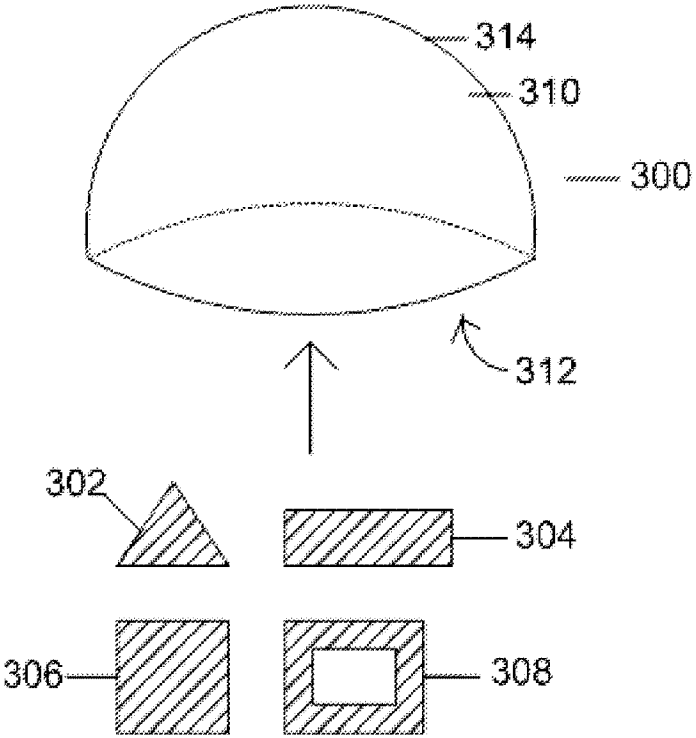
FIG. 3A illustrates a hat according to one embodiment.

FIG. 3A illustrates a hat 300 according to one embodiment. The hat 300 may have a plurality of thin force absorbing materials 302, 304, 306, 308. Each of the plurality of thin force absorbing materials 302, 304, 306, 308 may be formed of different shapes. The protective hat 300 may be formed by coupling the plurality of thin force absorbing materials 302, 304, 306, 308 to a hat 310.

The hat 310 may have an interior surface 312 and an exterior surface 314. The hat 300 may be any known hat such as a beanie, a knitted hat, woven hat, a cap, and the like. The hat 300 may be formed from any woven fabric material such as polyester, cotton, rayon, wool, plastic, any combination of the above, and the like. The fabric material may be breathable, durable, stretchable, machine washable, water resistant, or any combination of characteristics.

In one embodiment, the hat 310 may be construed to fully enclose the thin force absorbing member 302, 304, 306, 308, thus concealing the thin force absorbing member 302, 304, 306, 308 from view. This feature may encourage young children to wear the hat because it has a more fashionable looking than a regular safety helmet.

Any number, size or assembly may be utilized in the construction of the thin force absorbing member 302, 304, 306, 308, so long as the thin force absorbing member adequately protect the user's head from injuries caused by falls against hard objects. In one embodiment, the plurality of the thin force absorbing member 302, 304, 306, 308 may be positioned such that they cover multiple portions of the hat 310.

The thin force absorbing member 302, 304, 306, 308 may have various thicknesses. In one embodiment, the thin force absorbing member 302, 304, 306, 308 may have a thickness of approximately 0.5 to 20 millimeters (mm). In another embodiment, the thin force absorbing member 302, 304, 306, 308 may have a thickness of approximately 0.5 to 10 mm. In still another embodiment, the thin force absorbing member 302, 304, 306, 308 may have a thickness of approximately 1 to 5 mm. In another example, the thickness of the thin force absorbing member 302, 304, 306, 308 may be gradient between 0.5 to 20 millimeters (mm). In another example, the thickness of the thin force absorbing material 302, 304, 306, 308 may be the same for each or may be different or may even vary within a given force absorbing member.

The thin force absorbing member 302, 304, 306, 308 may be made from a malleable, elastomeric, durable, pliable material, or a material with any combination of these characteristics. The thin force absorbing member 302, 304, 306, 308 may be any material such as elastomer, polyurethane foam, gel, silicone, and the like.

The thin force absorbing member 302, 304, 306, 308 may be formed in any shape. In one embodiment, the thin force absorbing member 302, 304, 306, 308 may be formed in a triangle 302, rectangle 304, square 306, hollow rectangle 308, or circle, oval, star, trapezoid, and the like. The thin force absorbing member 302, 304, 306, 308 may also be cylindrical, spherical, conic, and the like. In another embodiment, the thin force absorbing member 302, 304, 306, 308 may be formed in the shape of a gradient wedge.

FIG. 3B illustrates a protective hat 300 according to one embodiment. As illustrated in FIG. 3B, each plurality of individual thin force absorbing member 302, 304, 306, 308 may be separately secured to the fabric covering. In another example, such as FIG. 6, the plurality of thin force absorbing material 602 may be interconnected, as opposed to being individually positioned to each other. Still in another example, the protective hat may comprise a combination of interconnected thin force absorbing material and individual thin force absorbing material.

In one embodiment, the thin force absorbing member 302, 304, 306, 308 may be removably coupled to the hat for versatility. Still in another embodiment, the thin force absorbing member may have a plurality of openings designed to facilitate ventilation of the air passage.

In another embodiment, the at least one thin force absorbing member 302, 304, 306, 308 may be coupled between the inner surface 312 and the outer surface 314 of the hat 310. The at least one thin force absorbing member 302, 304, 306, 308 may be coupled between the inner surface 312 and the outer surface 314 of the hat 300 via any known securing method such as by sewing, the use of adhesives, snaps, hook and loop fasteners, screws, and the like.

In one embodiment, the force absorbing material, such as the thin force absorbing material 104, can be formed from any number of different shapes. The force absorbing material being used in a given body protection device can provided as a plurality of force absorbing member that can vary in shape, thickness and size. The shapes can be traditional, non-traditional or arbitrary. The shapes can also participate in providing an ornamental design to the given body protection device.

Figure 4:
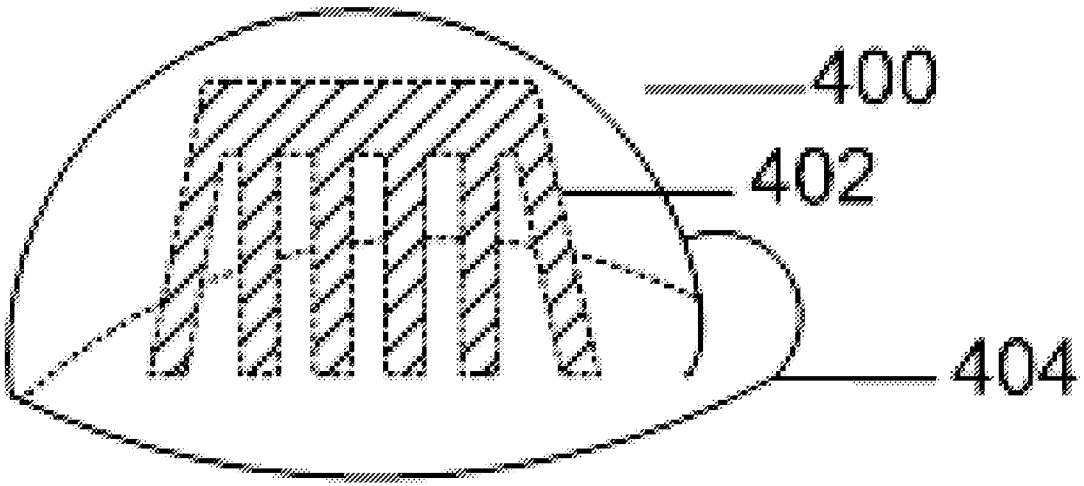
FIG. 4 illustrates one embodiment of a protective hat.

FIG. 4 illustrates one embodiment of a protective hat 400. Referring to FIG. 4, in one embodiment, the protective hat 400 may have a plurality of thin force absorbing materials formed as strips 402. The strips 402 can be separate members or can be commonly joined at a common base. The common base, if provided, all for possibly easier coupling of the strips 402 to the protective hat 400. In one embodiment, the protective hat 400 may have a projecting front brim 404. The projecting front brim 404 may shield the user from direct sunlight or rain.

Figure 5:
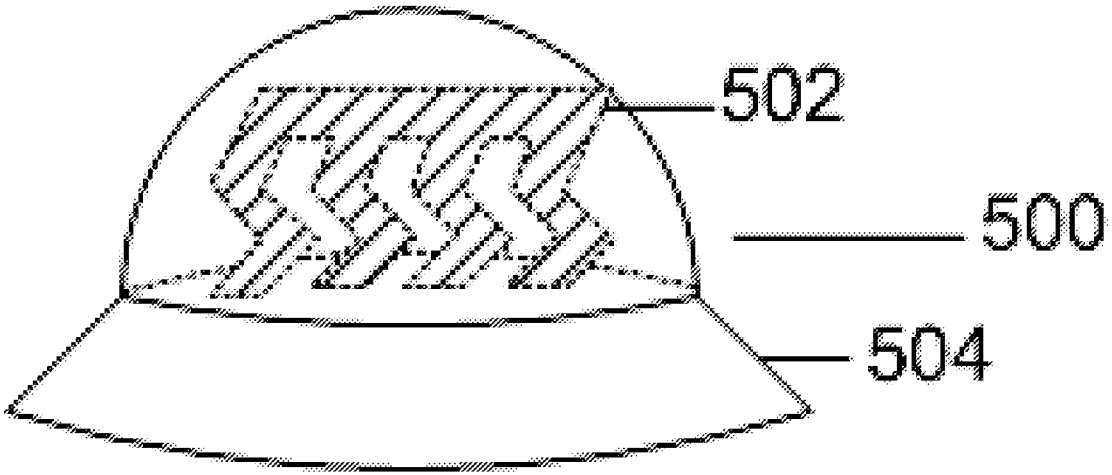
FIG. 5 illustrates another embodiment of a protective hat.

FIG. 5 illustrates another embodiment of a protective hat 500. Referring to FIG. 5, in one embodiment, the protective hat 500 may have a plurality of thin force absorbing materials formed of bent-shaped members 502. The bent-shaped members 502 can be separate members or can be commonly joined at a common base. The common base, if provided, all for possibly easier coupling of the bent-shaped members 502 to the protective hat 500. In one embodiment, the protective hat 500 may have a downwards brim 504.

Figure 6:
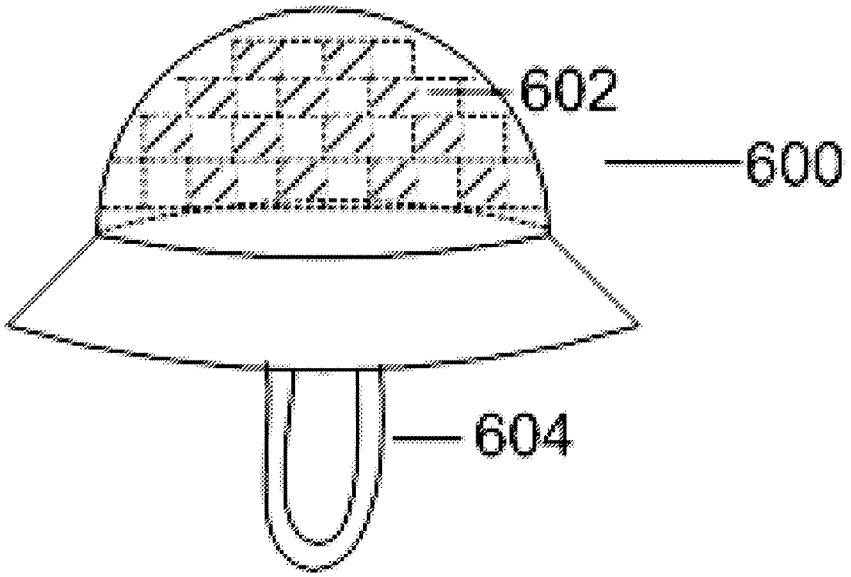
FIG. 6 illustrates still another embodiment of a protective hat.

FIG. 6 illustrates still another embodiment of a protective hat 600. Referring to FIG. 6, in one embodiment, the protective hat 600 may have a plurality of thin force absorbing materials formed as a mesh 602. The mesh 602 can provide a pattern for the force absorbing materials. The mesh 602 can provide good uniform coverage via force absorbing members for user protection while also providing uniform ventilation. The mesh 602 may be a contiguous piece or may be a plurality of force absorbing members arranged in a mesh. The mesh 602 may vary in shape and size, so long as it provides both protection and comfort to the user's head. In one embodiment, the protective hat 600 may have a chin strap 604 for securing the protective hat to the user. The chin strap 604 may be elastic and removable. The chin strap 604 may be formed from any woven fabric material such as polyester, cotton, rayon, wool, plastic, any combination of the above, and the like. The chin strap 604 may be coupled to the protective hat 600 via any known securing method such as by sewing, the use of adhesives, snaps, hook and loop fastener, and the like.

Figure 7:
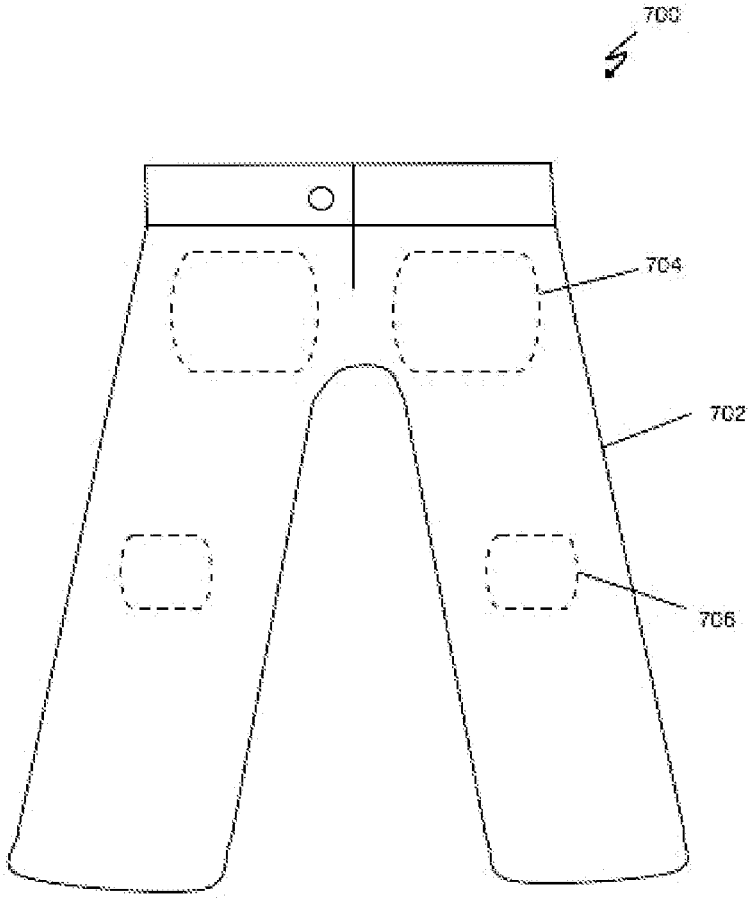
FIG. 7 illustrates one embodiment of a protective clothing device as a protective pair of pants.

FIG. 7 illustrates one embodiment of a protective clothing device as a protective pair of pants 700. The protective pair of pants 700 comprises a pair of pants 702 and at least one thin force absorbing member 704, 706.

The pair of pants 702 may be any known pair of pants such as denim jeans, khaki slacks, cotton, fleece, and the like. The pair of pants 702 may have an interior layer and an exterior layer. The pair of pants 702 may be made from a fabric material. The fabric material may be any woven material made from any material such as polyester, cotton, rayon, wool, plastic, and the like. The fabric material may be breathable, durable, stretchable, machine washable, or water resistant.

The at least one thin force absorbing member 704, 706 may be coupled to the pair of pants 702. The at least one thin force absorbing member 704, 706 may be coupled to any area of the pair of pants 702. For example, the at least one thin force absorbing member 706 may be coupled to the pair of pants to provide knee protection. As another example, the at least one thin force absorbing member 704 may be coupled to the pair the pants 702 to provide gluteus maximus protection. The at least one thin force absorbing member 704, 706 may be secured to the interior surface of the pair of pants 702 to form the protective pair of pants 700. In one embodiment, the at least one thin force absorbing member 704, 706 may be secured between the interior surface and the exterior surface of the pair of pants 702. The at least one thin force absorbing member 704, 706 may be coupled between the interior surface and the exterior surface of the pants via any known securing method. For example, the at least one thin force absorbing material 704, 706 may be coupled between the inner surface and the outer surface of the pair of pants 702 via any known securing method such as by stitching, adhesives, snaps, hook and loop fasteners, screws, and the like.

Figure 8A:
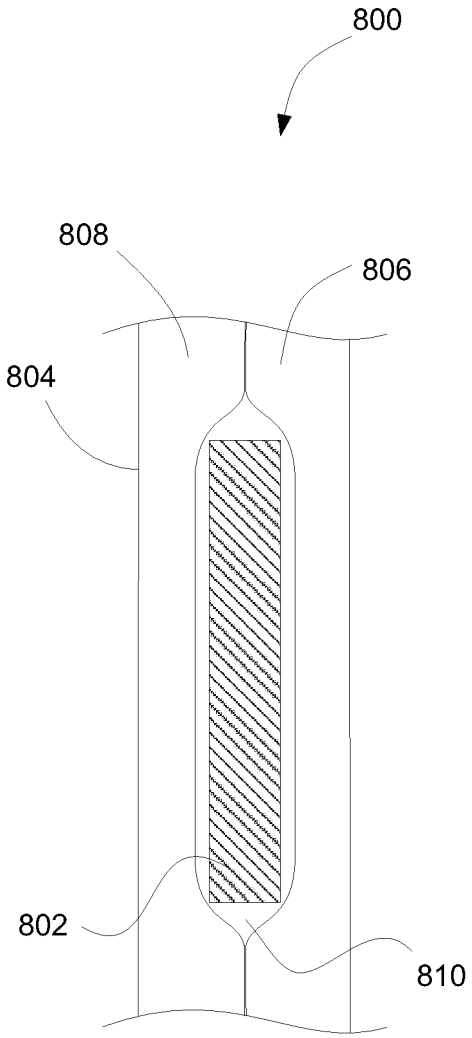
FIG. 8A-8D illustrate some of the methods of coupling a thin force absorbing member to an article of clothing to form a protective clothing device.
Figure 8C:
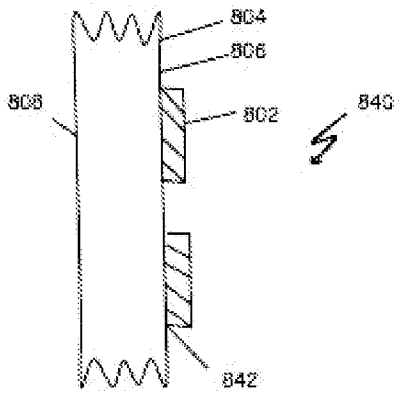
Figure 8B:
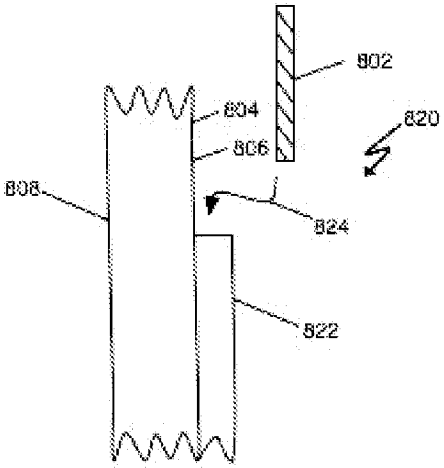

FIG. 8A-8C illustrate some embodiments of protective clothing devices having low-profile force absorbing members coupled to articles of clothing.

FIG. 8A illustrates one arrangement 800 for coupling a thin force absorbing member 802 secured to an article of clothing 804, according to one embodiment. The article of clothing 804 may have an interior surface 806 and an exterior surface 808. The article of clothing 804 may have an opening 810 between the interior 806 and the exterior surface 808. The opening 810 may be designed to receive the thin force absorbing member 802, or the opening 810 may just be a space that can be interposed between the interior surface 806 and the exterior surface. The article of clothing 804 may be made from a fabric material. The opening 810 may be formed by obtaining an article of clothing, placing the thin force absorbing member 802 in or at the opening 810, and securing the thin force absorbing member 802 in place. The thin force absorbing member 802 may be secured within the opening 810 by any known securing method such as by sewing the thin force absorbing member between the interior surface 806 and the exterior surface 808 of the hat, the use of adhesives, snaps, hook and loop fasteners, screws, and the like. The article of clothing 804 may be any known article of clothing such as a pair of pants, shirt, head gear (e.g., hat, headband), foot wear (e.g., sock), and the like. The fabric material may be any woven material made from any material such as polyester, cotton, rayon, wool, plastic, and the like. The fabric material may be breathable, durable, stretchable, machine washable, and/or water resistant. In one embodiment, the opening 810 is an enclosure, and the thin force absorbing member 802 can be inserted into the enclosure. The enclosure can be formed between the interior surface 806 and the exterior surface 808 of the article of clothing 804.

FIG. 8B illustrates one arrangement 820 for coupling a thin force absorbing member 802 secured to an article of clothing 804, according to another embodiment. The article of clothing 804 may have a sleeve 822 (or pocket) on the interior surface 806 (or in an alternative embodiment on the exterior surface 808 of the article of clothing 804). The sleeve 822 can be made from the same fabric material as the article of clothing 804. In one embodiment, the sleeve 822 may be configured to receive 824 the at least one thin force absorbing member 802. The sleeve 822 may be any known woven material made from any material such as polyester, cotton, rayon, wool, plastic, and the like. The sleeve 822 may be coupled to the article of clothing 804 by any known securing method such as by sewing, adhesives, snaps, hook and loop fasteners, screws and the like. Once the thin force absorbing member 802 may be inserted into the sleeve 822, the thin force absorbing member 802 may be secured within the sleeve 822 via any known securing method such as by sewing, adhesives, snaps, hook and loop fasteners, screws, and the like. The sleeve 822 may be configured to removably receive and conceal the thin force absorbing member 802, thus allowing easy removal or insertion of the thin force absorbing member 802 with respect to the sleeve 822.

FIG. 8C illustrates one arrangement 840 for coupling multiple thin force absorbing members 802, 842 to an article of clothing 804, according to another embodiment. The thin force absorbing members 802, 842 may be coupled to the interior surface 806 or the exterior surface 808 of the article of clothing 804. The thin force absorbing members 802, 842 may be secured to the interior surface 806 or the exterior surface 808 of the article of clothing 804 via any known securing method such as by sewing, adhesives, snaps, hook and loop fasteners, screws, and the like.

Figure 8D:
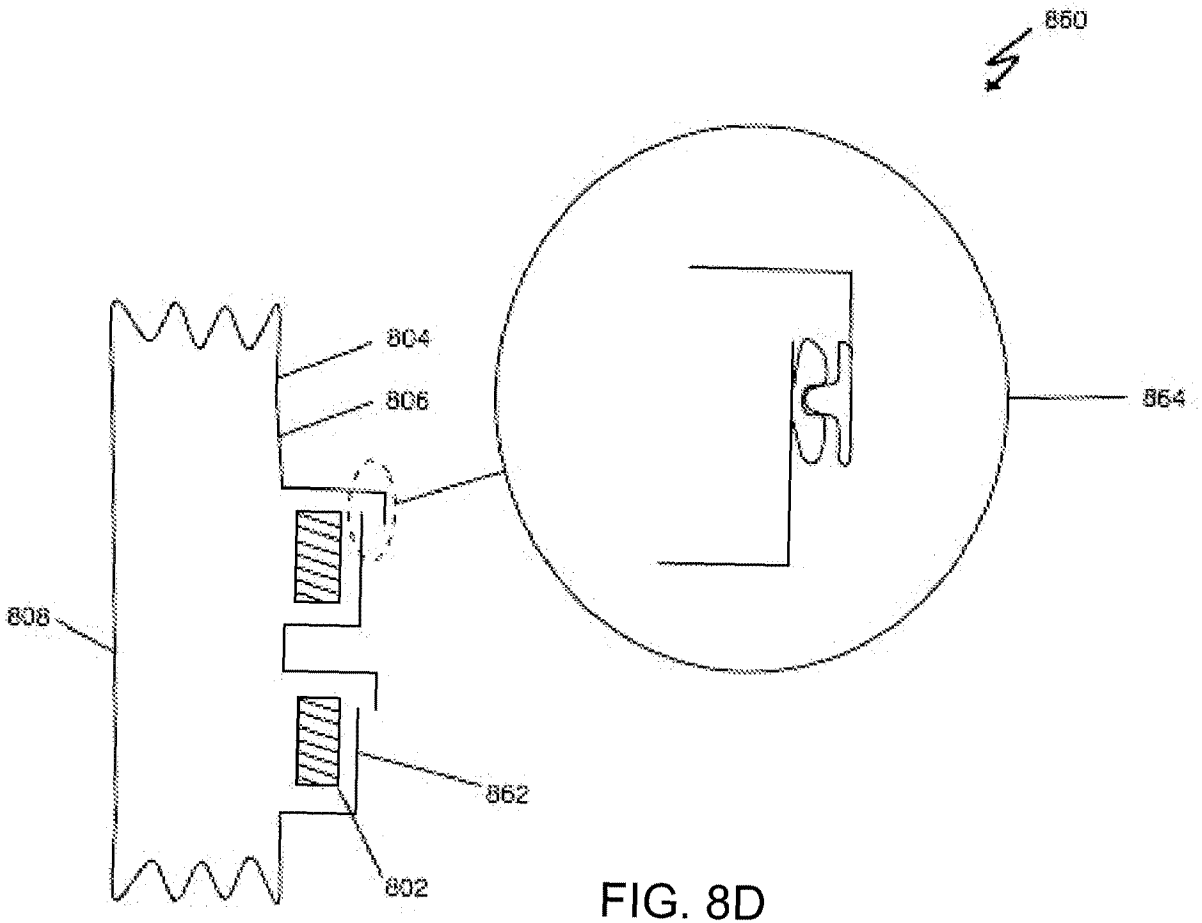

FIG. 8D illustrates one arrangement 860 for coupling a thin force absorbing member 802 secured to an article of clothing 804, according to another embodiment. The article of clothing 804 may have pockets 862 on the interior surface 806 (or in an alternative embodiment on the exterior surface 808 of the article of clothing 804). The pockets 862 can be made from the same fabric material as the article of clothing 804. In one embodiment, each of the pockets 862 may be configured to receive the at least one thin force absorbing member 802. The pockets 862 may be any known woven material made from any material such as polyester, cotton, rayon, wool, plastic, and the like. The pockets 862 may be coupled to the article of clothing 804 by any known securing method such as by sewing, adhesives, snaps, hook and loop fasteners, screws and the like. Once the thin force absorbing member 802 may be inserted into the pocket 862, the thin force absorbing member 802 may be secured within the pocket 862 via a flap (see blow-up section 864). Optionally, the flap can be secured to the pocket 862 via any known securing method such as by sewing, adhesives, snaps, buttons, hook and loop fasteners, screws, and the like. The pockets 862 may be configured to removably receive and conceal one or more of the thin force absorbing members 802, thus allowing easy removal or insertion of the thin force absorbing members 802 with respect to the pockets 862.

In everyday life, people experience forces to the body. These forces to the body come from bumping into objects, falling down, scrapping against objects, and the like. The forces to the body that people experience generally can result in scrapes, bruises, abrasions, and the like. The body protection device can protect the person's body from these forces to the body, minimizing the infliction, extent, or severity of these forces to the body.

The body protection device is especially important for young children. Young children, while learning to crawl, walk and interact with their environment often fall, crash, bump, scratch, run in to, and stub their body into objects and surfaces in their environment. Young children's heads are especially vulnerable to these forces to the body, and can often result in concussions. The body protection device can protect the young child from these forces to the body during their everyday activities. The body protection device when embodied as a protective hat, may be able to prevent the likelihood of young children sustaining concussions. The body protection device appears to be a piece of regular clothing. Since the body protection device looks and feels like any other article of clothing, the child will be encouraged to wear the body protection device in their every day activities.

Figure 9A:
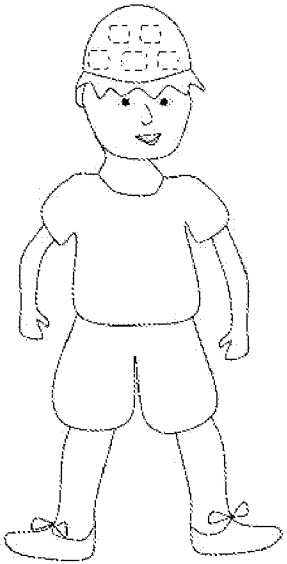
FIGS. 9A and 9B illustrates one use of a body protection device embodied in a protective hat.
Figure 9B:
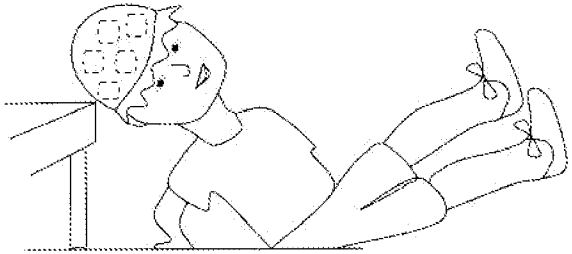

FIGS. 9A and 9B illustrates one use of a body protection device embodied in a protective hat. This application generally relates to protective clothing, and more particularly to a protective hat for a child. While learning to walk, the child frequently falls into hard objects, inflicting harm to the vulnerable head FIG. 9B. Since the protective hat is suitable for everyday wear, the protective hat provides a means for protection of the child's head while maximizing the likelihood of use through comfort, wearability and appearance FIG. 9A. However, as noted above, protection offered by wearable protective devices (e.g., protective clothing devices) can, in other embodiments, be provided in other types of clothing, such as a pair of pants, headband, shirt, and the like.

FIG. 9A illustrates an exemplary use of a protective hat according to one embodiment. A child is wearing the protective hat during daily life. The hat may be worn in every day use such as while learning to crawl, learning to walk, playing, running, and the like. The protective hat may be thin, breathable, stylish, comfortable so as to promote everyday use. Since the protective hat can have the appearance of a normal hat and is comfortable to wear, the child is more likely to wear the protective hat.

FIG. 9B illustrates a child falling and the protective hat operating to protect the child's head against a sharp object (e.g. edge of a table). Since children are prone to falling, the protective hat through the at least one thin force absorbing members helps shield the child's head from objects encountered in everyday play such as floors, furniture, toys, rocks, and the like.

The body protection devices (e.g., protective hats) discussed herein can be worn in different environments, including indoors or outdoors, or different seasons, including winter, summer, spring, or fall, or for different activities. As a result, an article of clothing and/or a force absorbing member of the body protection device may be made of different fabric materials with various thicknesses to provide comfort with protection. In one embodiment, an article of clothing for winter outdoor usage may be made of thick wool. In another embodiment, an article of clothing for summer outdoor activity may be made of thin cotton. In some cases, an article of clothing for outdoor sports, such as skiing, may be made of thicker material than an article of clothing for indoor activity or summer activity. The force absorbing member may have various thicknesses according to environmental temperature/climate or the wear's activity. In one embodiment, the force absorbing member for an outdoor sport, such as skiing, may be made of thicker material to provide the wearer more force absorbing protection. In another embodiment, the force absorbing member for an indoor activity, such as a children's play room, may be made of thin material that provides adequate protection for its wearer without being uncomfortable bulky or providing too much heat retention.

The various aspects, features, embodiments or implementations of the invention described above can be used alone or in various combinations.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A protective hat, comprising:

a fabric covering having an interior surface and an exterior surface; and at least one thin force absorbing member coupled to the interior surface of the fabric covering; and an inner layer of material arranged to cover the at least one thin force absorbing member and coupled to the fabric cover, the inner layer of material being separate and distinct from the at least one thin force absorbing member, wherein the at least one thin force absorbing member has a plurality of openings, wherein the at least one thin force absorbing member has a thickness of approximately 1 to 5 millimeters, and wherein the at least one thin force absorbing material comprises polyurethane foam.

2. A protective hat, comprising:

a fabric covering having an interior surface and an exterior surface; and at least one thin force absorbing member coupled to the interior surface or coupled between the interior surface and the exterior surface of the fabric covering, wherein the at least one thin force absorbing member has a plurality of openings, wherein the at least one thin force absorbing member has a thickness of approximately 1 to 5 millimeters, and wherein the at least one thin force absorbing material comprises polyurethane foam.

3. The protective hat in claim 2, wherein the plurality of openings are designed to facilitate ventilation.

4. The protective hat in claim 2, wherein the at least one thin force absorbing member comprises a plurality of individual thin force absorbing members separately secured to the fabric covering.

5. The protective hat in claim 4, wherein the plurality of thin force absorbing members are formed from different shapes.

6. The protective hat in claim 2, wherein the fabric covering is made of a woven member.

7. The protective hat in claim 2, wherein the at least one thin force absorbing member comprises a malleable, elastomeric, or pliable member.

8. The protective hat in claim 2, wherein the at least one thin force absorbing member is concealed by the fabric covering.

9. The protective hat of claim 2, wherein the at least one thin force absorbing member has a gradient thickness of approximately 1 to 5 millimeter.

10. The protective hat of claim 2, wherein the at least one thin force absorbing member is a mesh configuration.

11. The protective hat of claim 2, further comprising:

wherein the at least one thin force absorbing member comprises a plurality of thin force absorbing members that combine to provide impact force protection to a wearer of the protective hat.

12. The protective hat of claim 11, wherein the plurality of thin force absorbing members have a plurality of different sizes and shapes.

13. A protective hat, comprising:

a fabric covering having an interior surface and an exterior surface; and at least one thin force absorbing member provided internal to the fabric covering, wherein the at least one thin force absorbing member has a plurality of openings, wherein the at least one thin force absorbing member has a thickness of approximately 1 to 5 millimeters, and wherein the at least one thin force absorbing material consists of polyurethane foam.

14. The protective hat of claim 13, wherein the at least one thin force absorbing member is concealed by the fabric covering.

15. The protective hat of claim 13, wherein the at least one thin force absorbing member comprises a plurality of thin force absorbing members separately secured to the fabric covering that combine to provide impact force protection to a wearer of the protective hat.

16. The protective hat of claim 15, wherein the plurality of thin force absorbing members have a plurality of different sizes and shapes.

17. The protective hat of claim 13, wherein the plurality of openings are designed to facilitate ventilation.

18. The protective hat of claim 13, wherein the at least one thin force absorbing member is sewn to the interior surface of the fabric covering.

* * * * *